US010030344B1

(12) United States Patent
Morales Flores et al.

(10) Patent No.: US 10,030,344 B1
(45) Date of Patent: Jul. 24, 2018

(54) ROADWAY BARRIER BICYCLE SAFETY APPARATUS

(71) Applicant: LINDSAY TRANSPORTATION SOLUTIONS, INC., Rio Vista, CA (US)

(72) Inventors: Alvaro E. Morales Flores, Vacaville, CA (US); Jason T. Lim, Stockton, CA (US); Daniel Paul Dacayanan Loya, Elk Grove, CA (US); Christopher A. Sanders, Moraga, CA (US); Erik Weber, Vacaville, CA (US); Steve Johnson, Pebble Bay Condo (SG)

(73) Assignee: Lindsay Transportation Solutions, Inc., Rio Vista, CA (US)

( * ) Notice: Subject to any disclaimer, the term of this patent is extended or adjusted under 35 U.S.C. 154(b) by 0 days.

(21) Appl. No.: 15/812,201

(22) Filed: Nov. 14, 2017

(51) Int. Cl.
*E01F 15/00* (2006.01)
*E01F 15/08* (2006.01)

(52) U.S. Cl.
CPC ..... *E01F 15/088* (2013.01); *E01F 15/086* (2013.01)

(58) Field of Classification Search
CPC ..... E01F 15/086; E01F 15/088
USPC ..... 404/6, 9
See application file for complete search history.

(56) References Cited

U.S. PATENT DOCUMENTS

| | | | | |
|---|---|---|---|---|
| 5,052,850 | A | 10/1991 | Bishop | |
| 5,429,449 | A | 7/1995 | Baatz | |
| 7,168,882 | B1 | 1/2007 | Owen | |
| 7,950,871 | B2 | 5/2011 | Lass et al. | |
| 8,622,648 | B2 | 1/2014 | Mustafa | |
| 2004/0197140 | A1 | 10/2004 | Maleska | |
| 2005/0135878 | A1 | 6/2005 | McNally et al. | |
| 2009/0047067 | A1* | 2/2009 | Hannah | E01F 9/588 404/9 |
| 2013/0189030 | A1* | 7/2013 | Miracle | E01F 13/048 404/6 |
| 2014/0334875 | A1 | 11/2014 | Hoffman | |

* cited by examiner

*Primary Examiner* — Raymond W Addie
(74) *Attorney, Agent, or Firm* — Thomas R. Lampe

(57) ABSTRACT

Roadway barrier bicycle safety apparatus for attachment to an upper portion of a roadway barrier segment for topping the upper portion to prevent a bicycle from extending over the upper portion. The apparatus includes a shell having a curved upper surface and configured to prevent snagging of a bicycle or bicycle rider.

15 Claims, 10 Drawing Sheets

ROADWAY BARRIER BICYCLE SAFETY APPARATUS

TECHNICAL FIELD

This invention relates to roadway barriers and more particularly to roadway barrier bicycle safety apparatus for attachment to an upper portion of a roadway barrier segment and for topping the upper portion to prevent a bicycle from extending over the upper portion, creating a safer situation for a cyclist.

BACKGROUND OF THE INVENTION

Roadway barriers are in widespread use and such barriers often incorporate a string of interconnected roadway barrier segments.

Modifications have been made to roadway barrier segments and continuous roadway barriers for various purposes. Prior art arrangements believed to be representative of the state of the art in the field of such devices and modifications are disclosed in the following patent documents:

U.S. Pat. No. 5,052,850, issued Oct. 1, 1991, U.S. Pat. No. 7,168,882, issued Jan. 30, 2007, U.S. Pat. No. 5,429,449, issued Jul. 4, 1995, U.S. Pat. No. 8,622,648, issued Jan. 7, 2014, U.S. Pat. No. 7,950,871, issued May 31, 2011, U.S. Patent App. Pub. No. US 2014/0334875, published Nov. 13, 2014, U.S. Patent App. Pub. No. US 2004/0197140, published Oct. 7, 2004 and U.S. Patent App. Pub. No. US 2005/0135878, published Jun. 23, 2005.

The prior art approaches do not address a major problem solved by the present invention, which is to afford protection and safety for bicyclists passing or otherwise next to the barrier.

BRIEF SUMMARY OF THE INVENTION

The present invention relates to apparatus which effectively affords protection for a cyclist and the cyclist's bicycle. The apparatus of the present invention quickly and effectively supplements existing roadway barrier segments to carry out such purpose.

In addition to reducing the chance of a cyclist going over the barrier, another very important function is to reduce the interaction of the errant cyclist with the upper portion of the barrier since it has been shown to be very injurious for some types of barriers (especially guardrail systems). Most highway barriers are designed to interface with motor vehicles impacting the sides of the barrier and redirecting the vehicle back onto the roadway at a shallow angle but many have very sharp structural projections on top. The apparatus of the present invention reduces snags or potential to snag.

The apparatus also can act as a glare screen to oncoming traffic headlights or as a "gawk screen".

The apparatus may be utilized with different types of highway barriers, including guardrail systems.

The roadway barrier cyclist safety apparatus of the present invention is for attachment to an upper portion of a roadway barrier segment and for topping the upper portion to prevent a bicycle from extending over the upper portion and avoid snagging the bicycle or rider.

The apparatus includes an elongated hollow shell having a shell top, a shell bottom, opposed shell side walls extending from the shell top and the shell bottom and opposed shell ends extending upwardly from the shell bottom to the shell top.

The shell bottom generally conforms in size and shape to an upper roadway barrier segment surface of the roadway barrier segment. The opposed shell side walls and opposed shell ends are substantially aligned with sides and ends of the upper portion of the roadway barrier segment when the elongated hollow shell is attached to the upper portion of the roadway barrier segment.

The opposed shell side walls and the opposed shell ends extend upwardly. The shell top is attached to the opposed shell side walls and the opposed ends and configured to define a shell top upper surface which is smoothly curved over substantially the extent thereof.

Attachment structure is utilized to attach the elongated hollow shell in position on the roadway barrier segment upper portion and the shell configured so that it does not extend from the upper portion of the roadway barrier toward a passing bicycle and cyclist.

Other features, advantages and objects of the present invention will become apparent with reference to the following description and accompanying drawings.

DETAILED DESCRIPTION OF THE INVENTION

Figure 1:
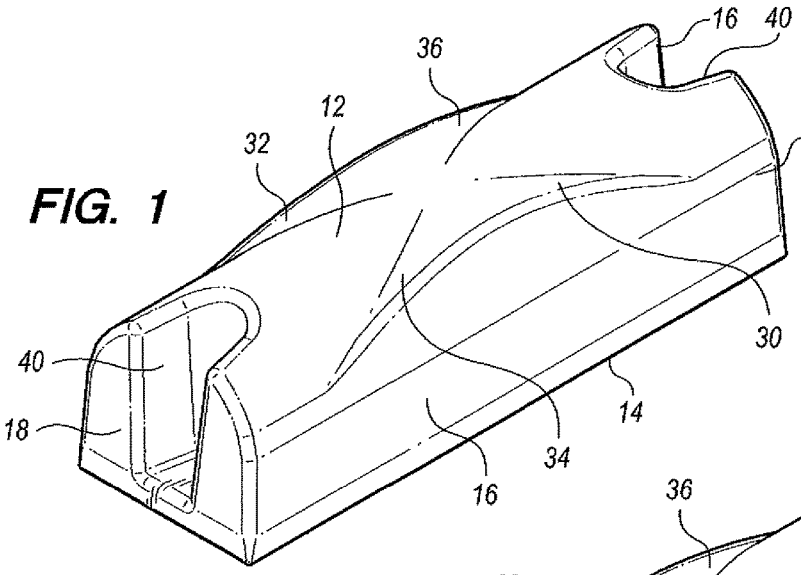
FIG. 1 is a perspective view of one embodiment of the invention which is of single piece molded plastic construction.
Figure 2:
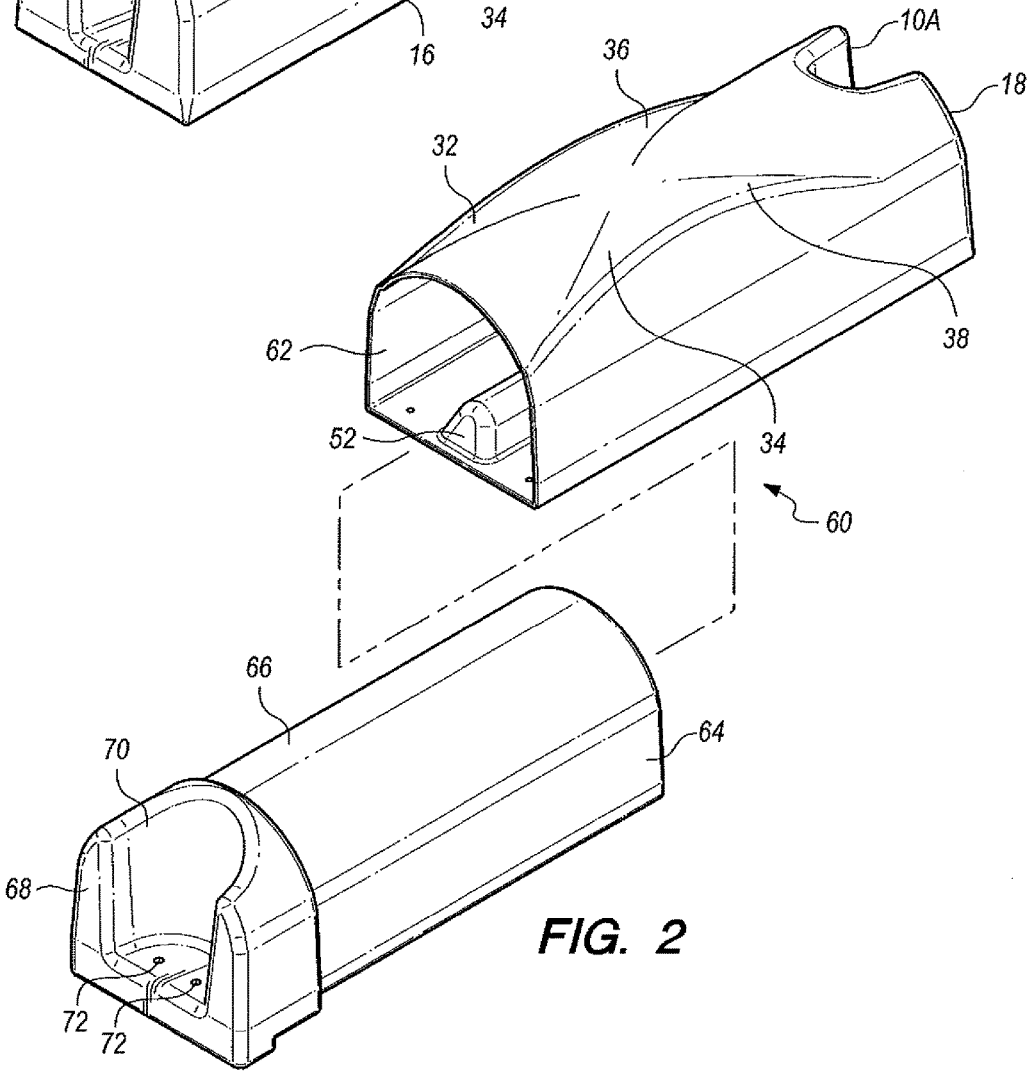
FIG. 2 is a perspective, exploded view illustrating components of a second embodiment of the invention including a modified outer shell similar to that illustrated in FIG. 1 with respect to the first embodiment and a second component in the form of a core member prior to insertion thereof into the outer shell.
Figure 3:
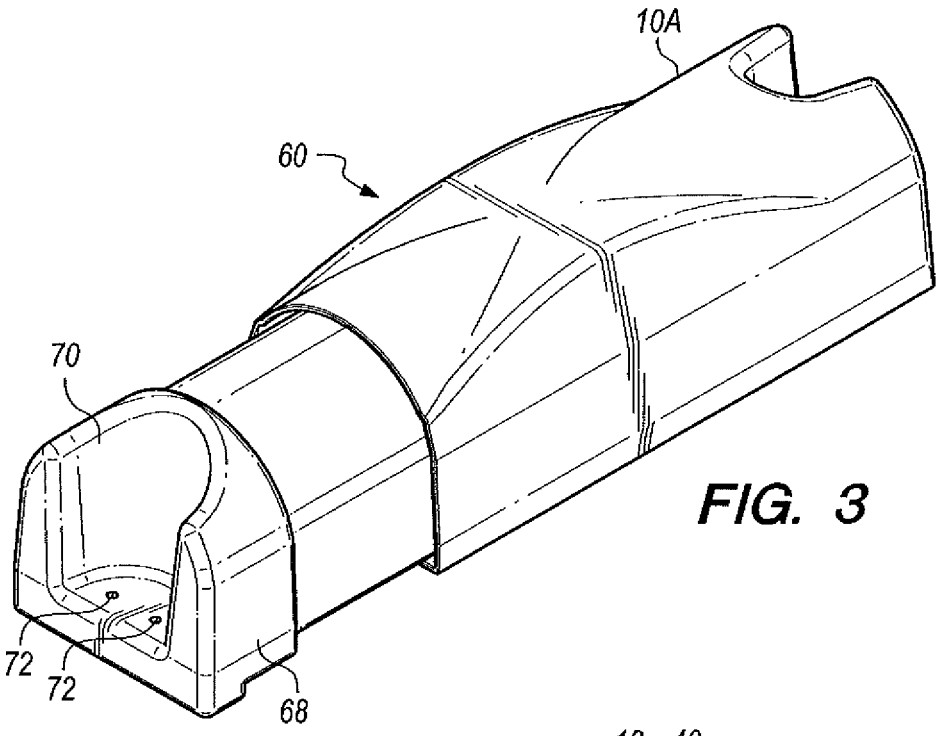
FIG. 3 is a perspective view of the second embodiment with the core member inserted part way into the outer shell.
Figure 4:
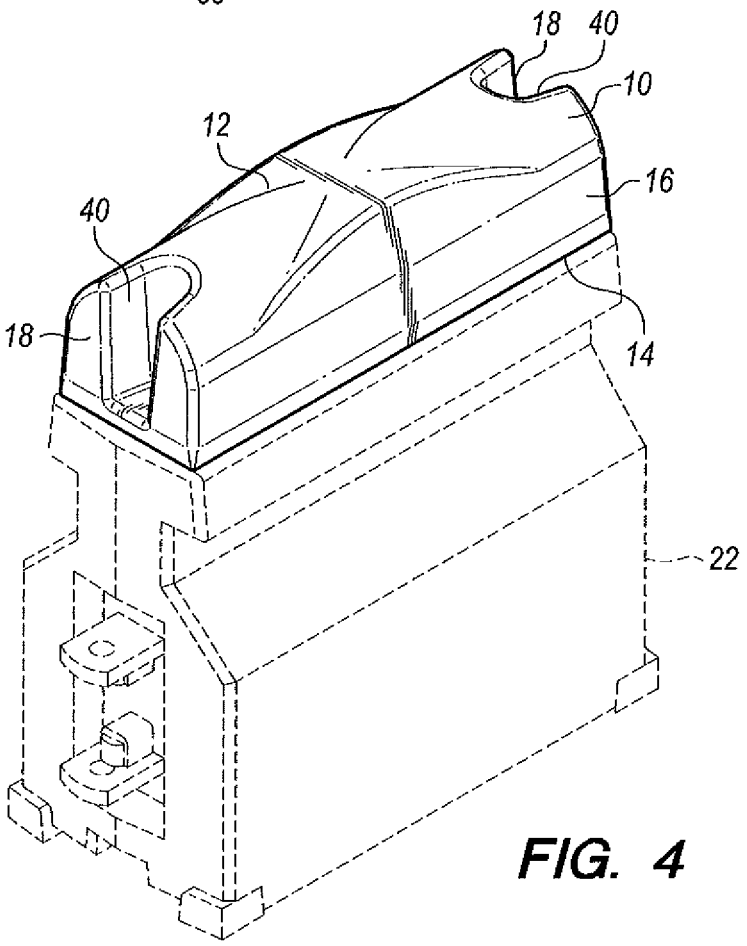
FIG. 4 is a perspective view illustrating the first embodiment of the invention comprising only the outer shell positioned on a typical conventional roadway barrier segment shown in dash lines.
Figure 5:
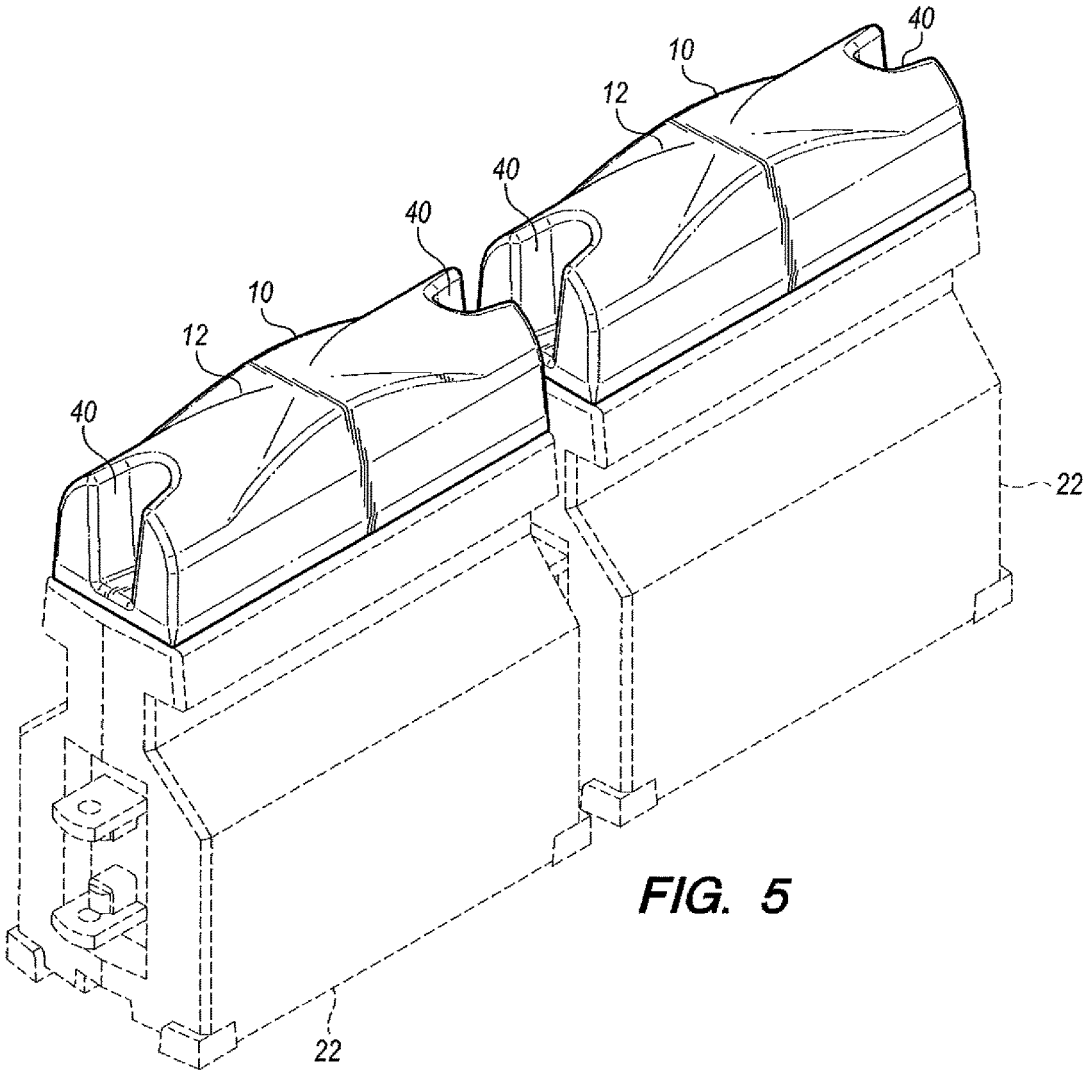
FIG. 5 is a view similar to FIG. 4, but illustrating the apparatus of the first embodiment located on each of two roadway barrier segments which are connected and which are shown in dash lines.
Figure 6:
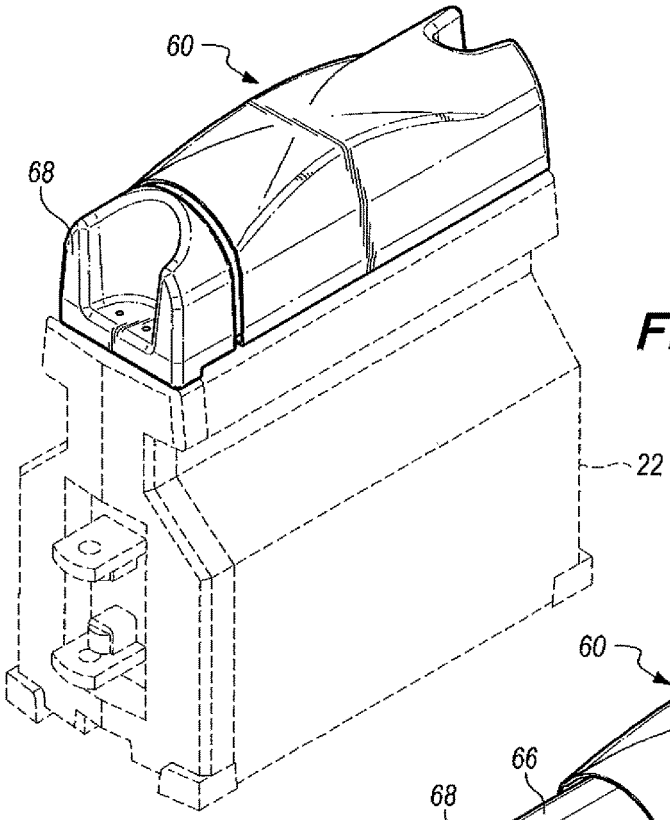
FIG. 6 is a view similar to FIG. 4, but illustrating the apparatus of the second embodiment located on a roadway barrier segment, the apparatus being in unextended condition.
Figure 7:
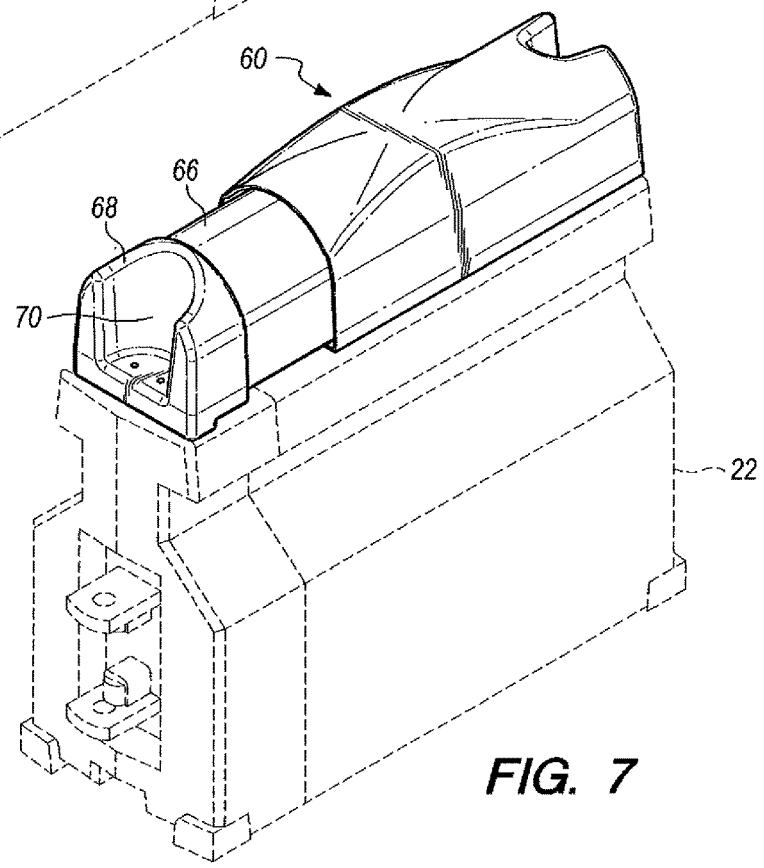
FIG. 7 is a view similar to FIG. 6, but illustrating the apparatus of the second embodiment in extended condition and covering a roadway barrier segment of the type shown in FIG. 6 employed in conjunction with an additional extension barrier segment, both being shown in dash lines.
Figure 8:
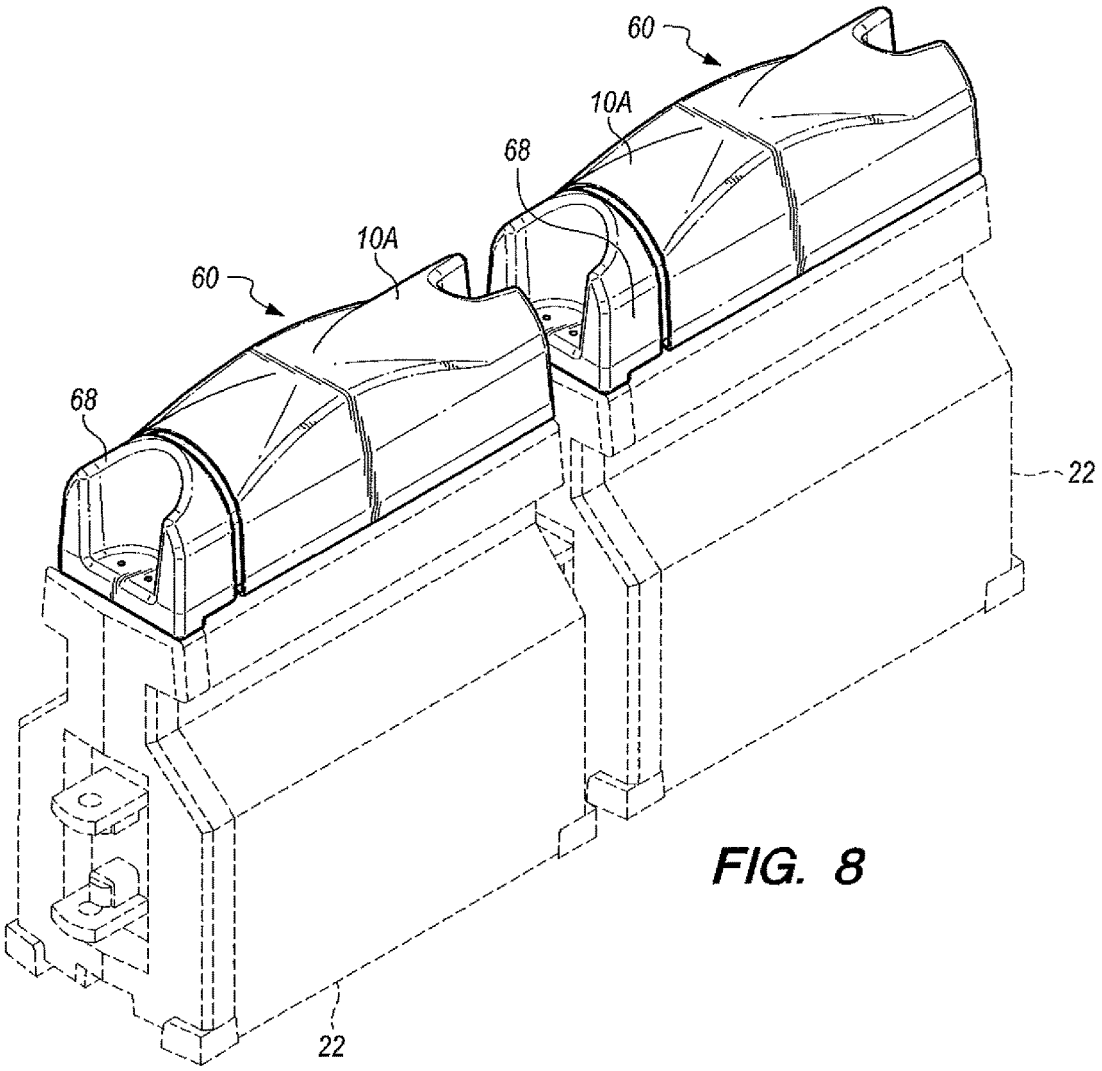
FIG. 8 is a view similar to FIG. 5, but illustrating two of the second embodiment apparatuses on adjacent roadway barrier segments, the latter shown by dash lines, the embodiments both in unextended condition.
Figure 9:
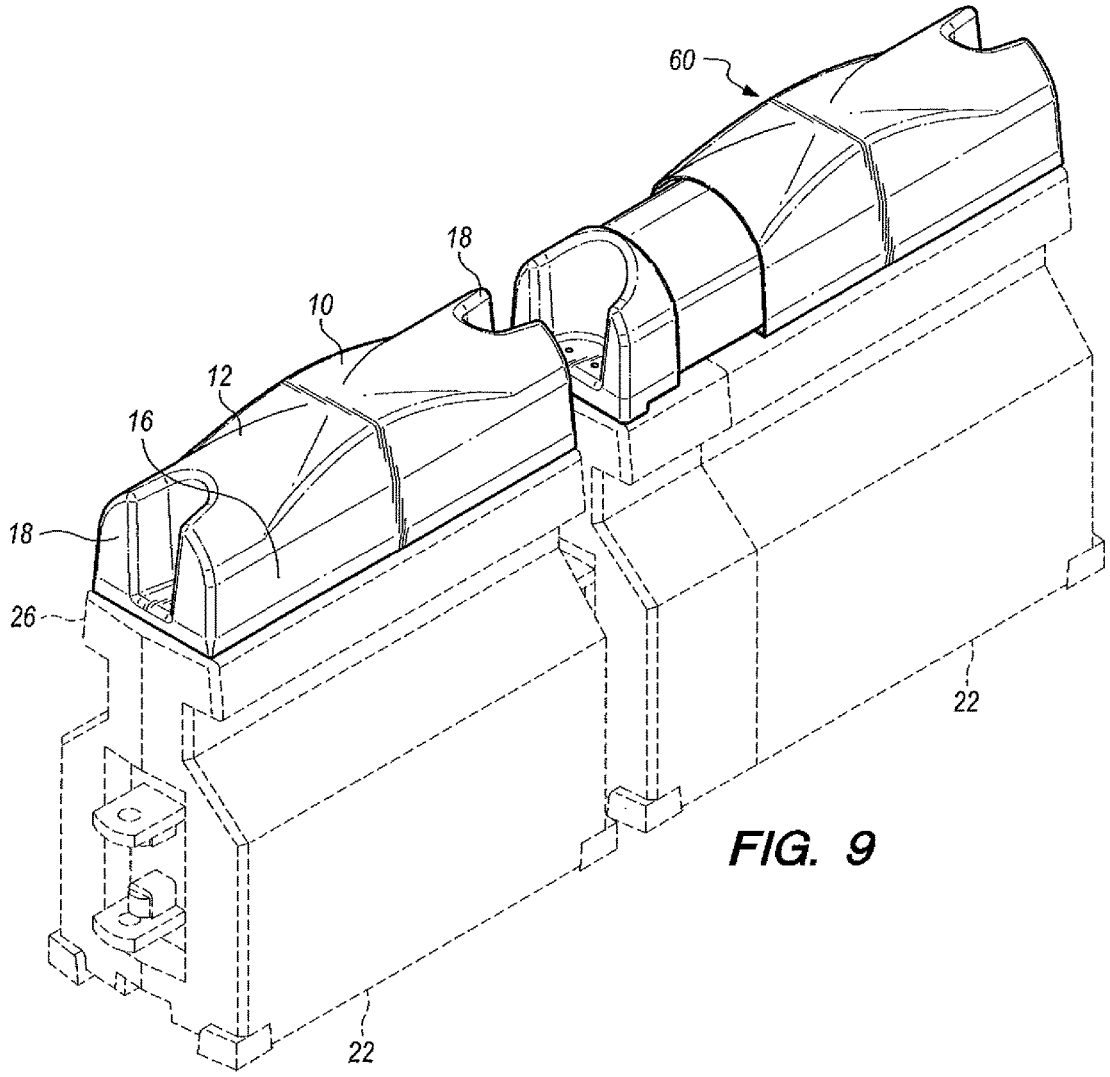
FIG. 9 is a view similar to FIG. 8, but showing both of the embodiments of the apparatus on adjacent roadway barrier segments, one being longer than the other segment and the apparatus second embodiment shown in extended condition.

Referring now to FIGS. 1, 4, 5, 9, 10-13 of the drawings, a first embodiment of apparatus constructed in accordance with the teachings of the present invention is illustrated. The apparatus includes an elongated hollow shell 10 for attachment to an upper portion of a roadway barrier segment and for topping the upper portion to prevent a passing bicycle and cyclist from extending or vaulting over the upper portion or snagging the passing bicycle and cyclist. The shell 10 may be constructed of polymer or other suitable material.

The elongated hollow shell 10 has a shell top 12, a shell bottom 14, opposed shell side walls 16 extending between the shell top and shell bottom, and shell ends 18 extending upwardly from the shell bottom to the shell top.

The shell bottom 14 generally conforms in size and shape to an upper roadway barrier segment surface 20 of a roadway barrier segment 22 (shown in solid lines in FIG. 11 and dash lines in other figures) so that the shell does not snag a passing bicycle and cyclist.

The illustrated roadway barrier segment 22 is of known construction and is merely representative of the roadway barrier constructions with which the present invention may be utilized. The terms "roadway barrier" and "roadway barrier segment" encompass all types of highway barriers, including guardrail systems. As is conventional, in the disclosed roadway barrier, the roadway barrier segments are secured at the ends thereof by suitable connector structure whereby a plurality of roadway barrier segments form an elongated string.

Figure 10:
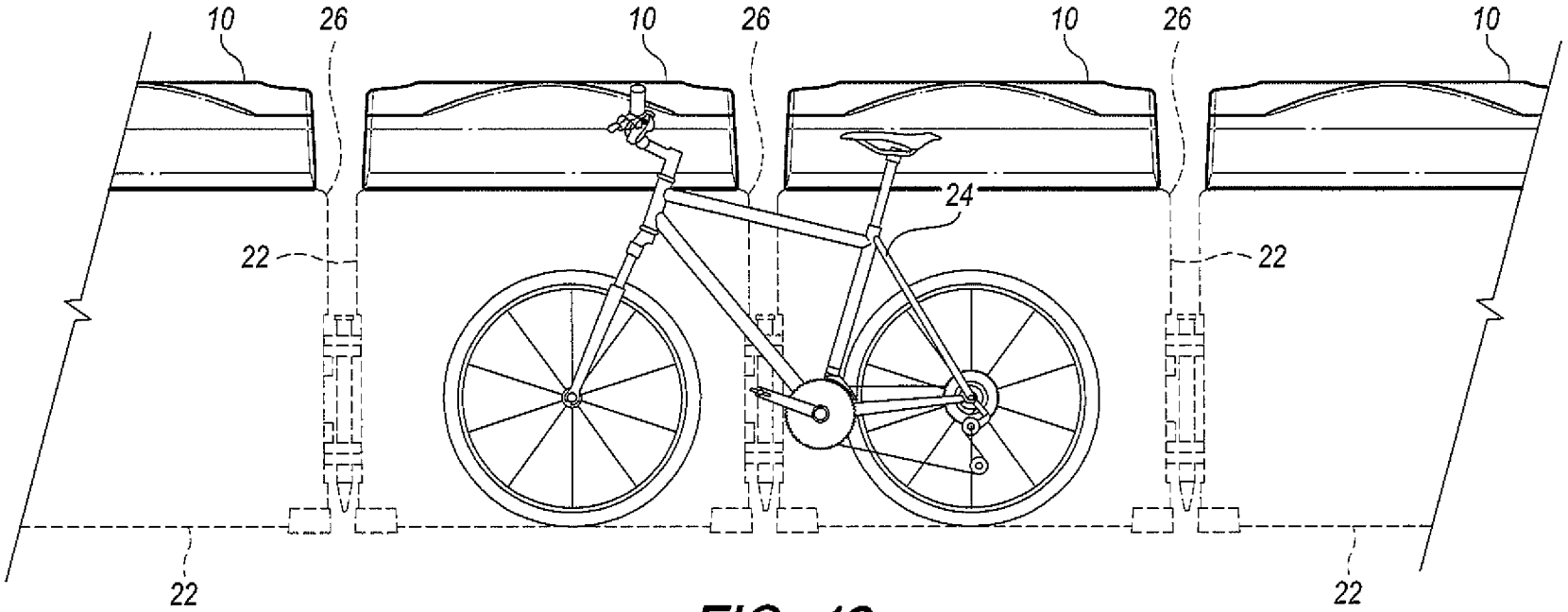
FIG. 10 is an elevation view showing a plurality of the first embodiment apparatuses on adjoining connected roadway barrier segments in a string thereof and illustrating a conventional bicycle in position next to the barrier string.

FIG. 10 shows a bicycle 24 next to a string of connected roadway barrier segments 22 and in accordance with the present invention (and as shown in FIG. 10) the shell 10 is attached to and tops the upper portions 26 of the roadway barrier segments, being sized and positioned to prevent a bicycle such as bicycle 24 from extending over the upper portion, which could result in injury.

When installed, the shell side walls 16 and opposed shell ends 18 are substantially aligned with sides and ends of the upper portion of the roadway barrier segment. The opposed shell side walls and opposed shell ends extend upwardly.

The shell top 12 attached to the opposed shell side walls and the opposed shell ends is configured to define a shell top upper surface curved over substantially the full extent thereof including a plurality of converging convexly curved shell top upper surface portions 32, 34, 36, 38. The shell top upper surface structural shape, while preventing a bicycle from extending over the upper portion, does not snag or otherwise affect to any significant degree forward progress of the bicycle and cyclist. Likewise, such shape will not cause any harm to the cyclist. The convexly curved shell top upper surface portions converge toward a location substantially midpoint along the shell top.

The opposed shell ends 18 define recesses 40 at each of the ends.

Figure 11:
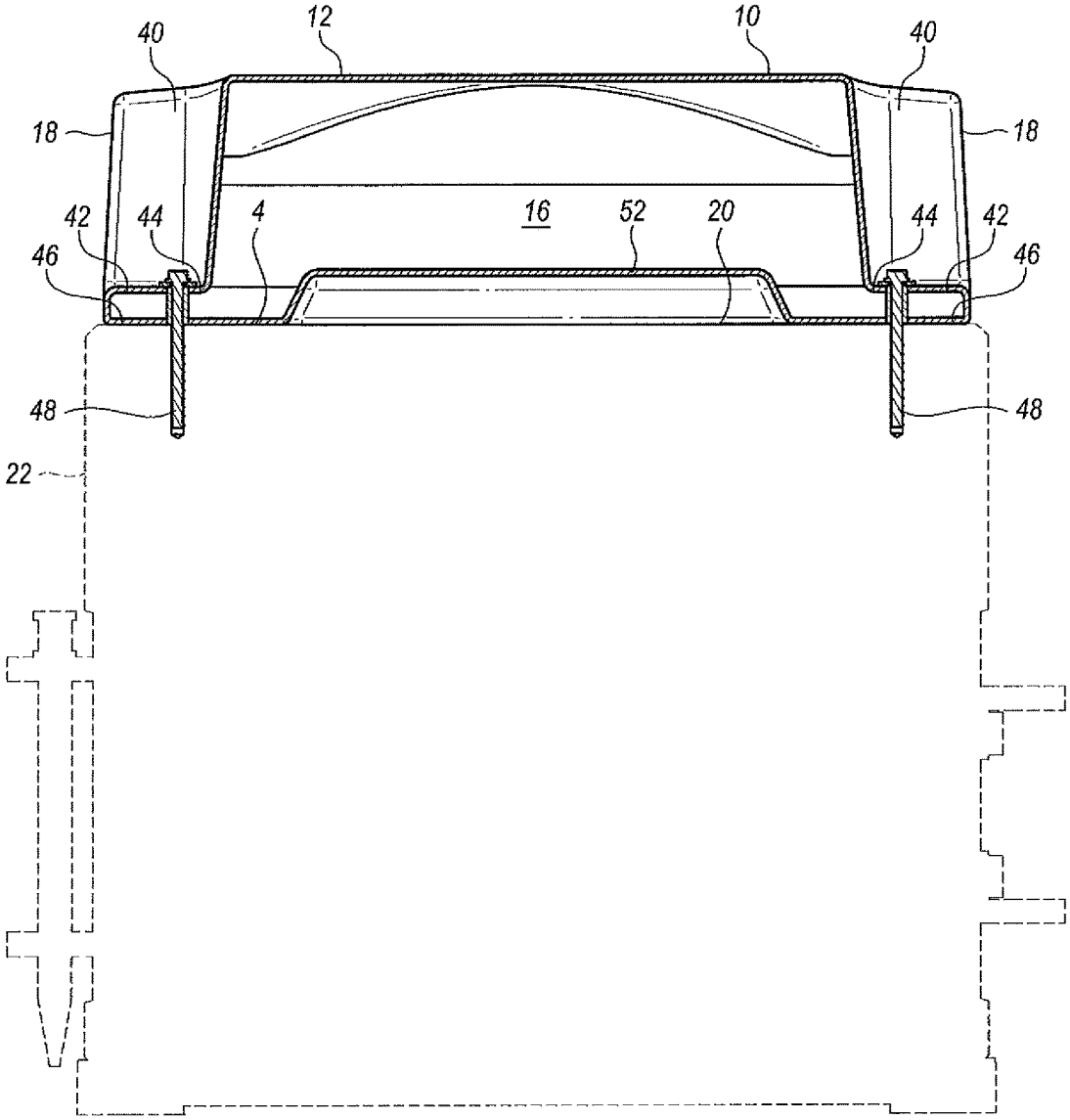
FIG. 11 is a greatly enlarged, cross-sectional view showing an apparatus embodiment in position on top of a conventional representative roadway barrier segment and fastened thereto by bolts.
Figure 12:
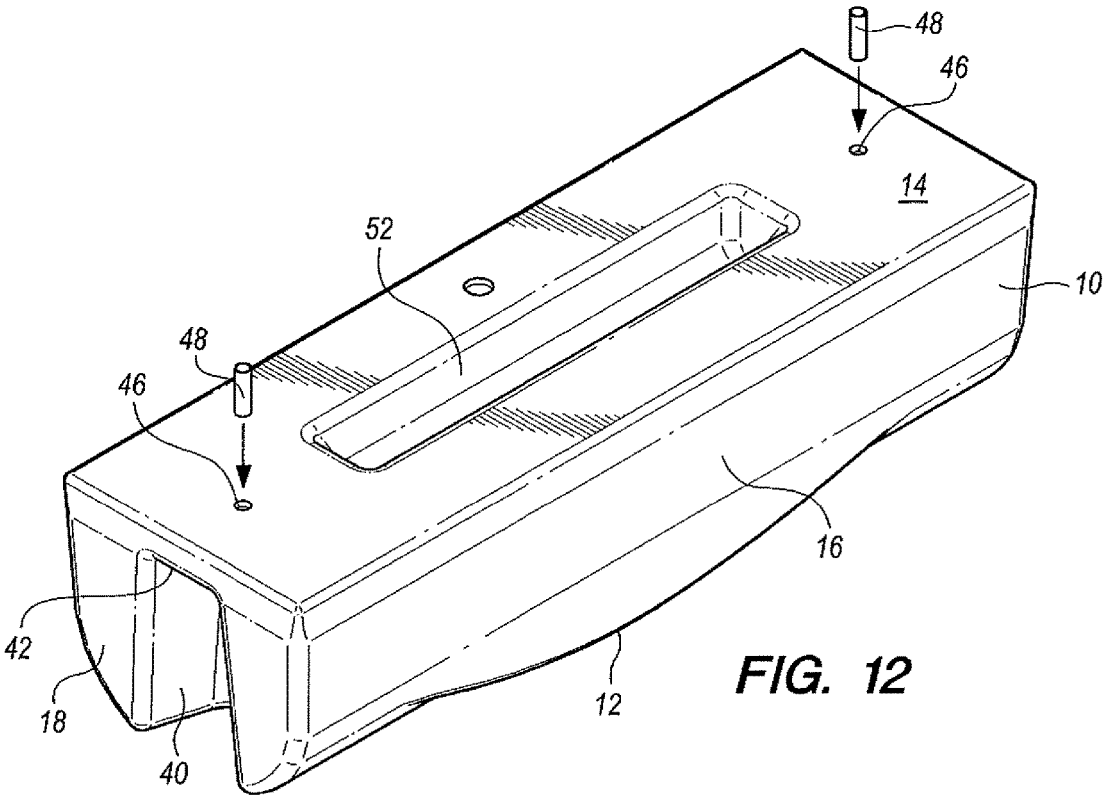
FIG. 12 is an enlarged, bottom perspective view showing installation of reinforcement sleeves in mounting holes of the apparatus embodiment of FIG. 11.
Figure 13:
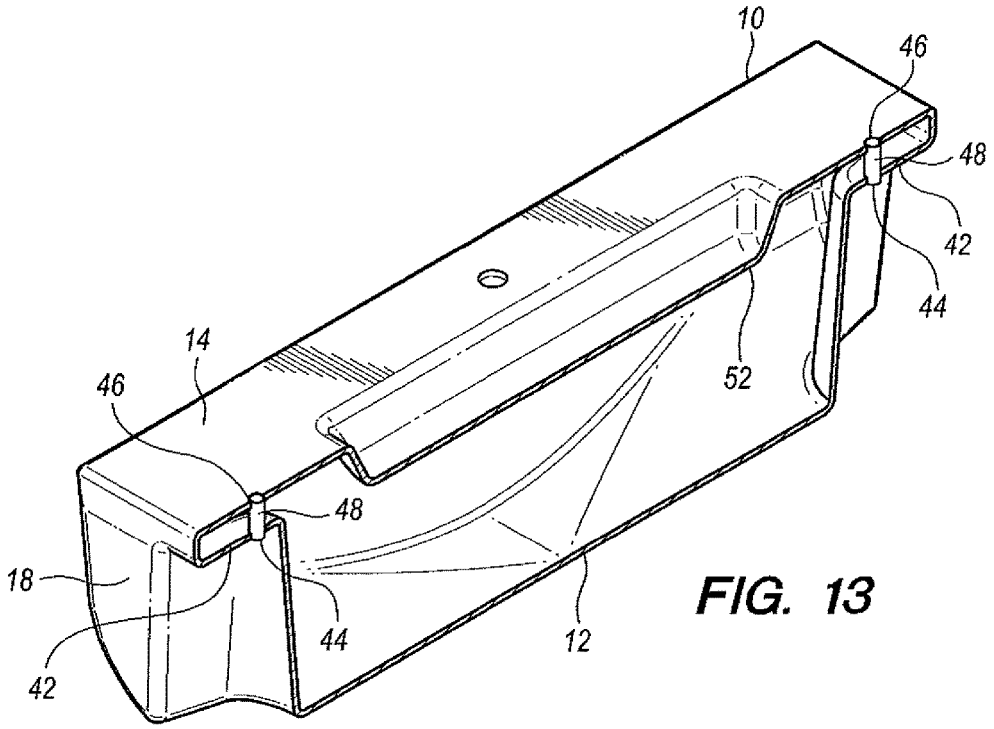
FIG. 13 is a cross-sectional view showing the sleeves installed and in place.
Figure 14:
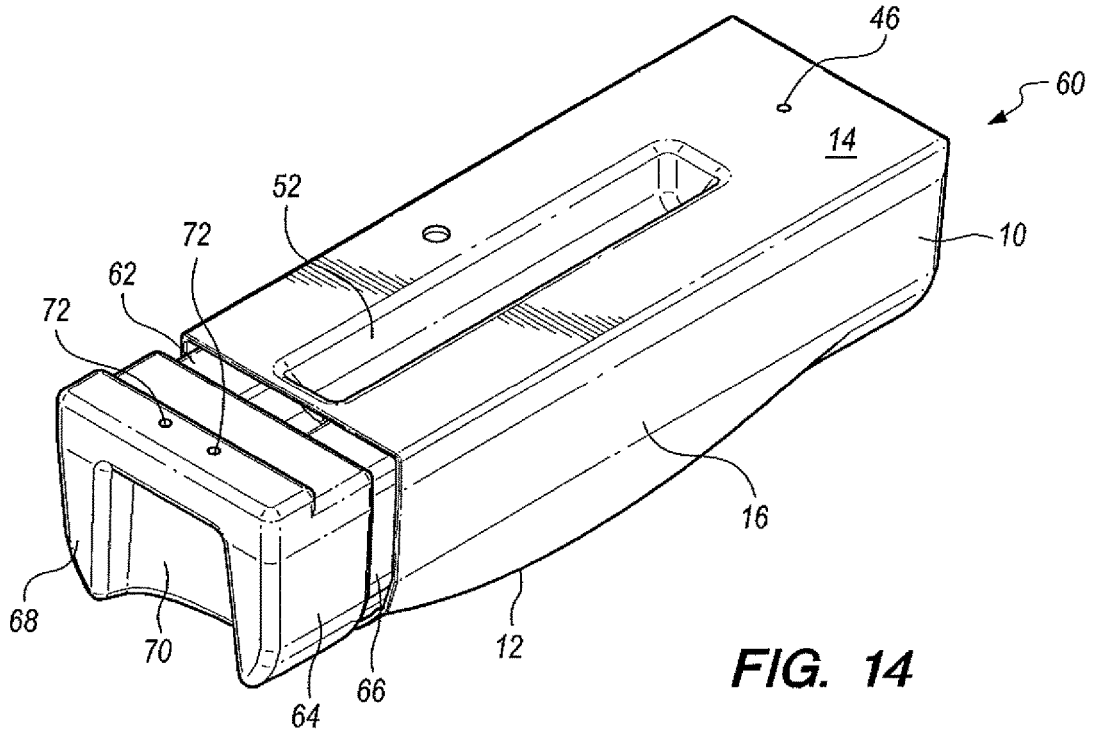
FIG. 14 is a bottom perspective view of the second embodiment apparatus.
Figure 15:
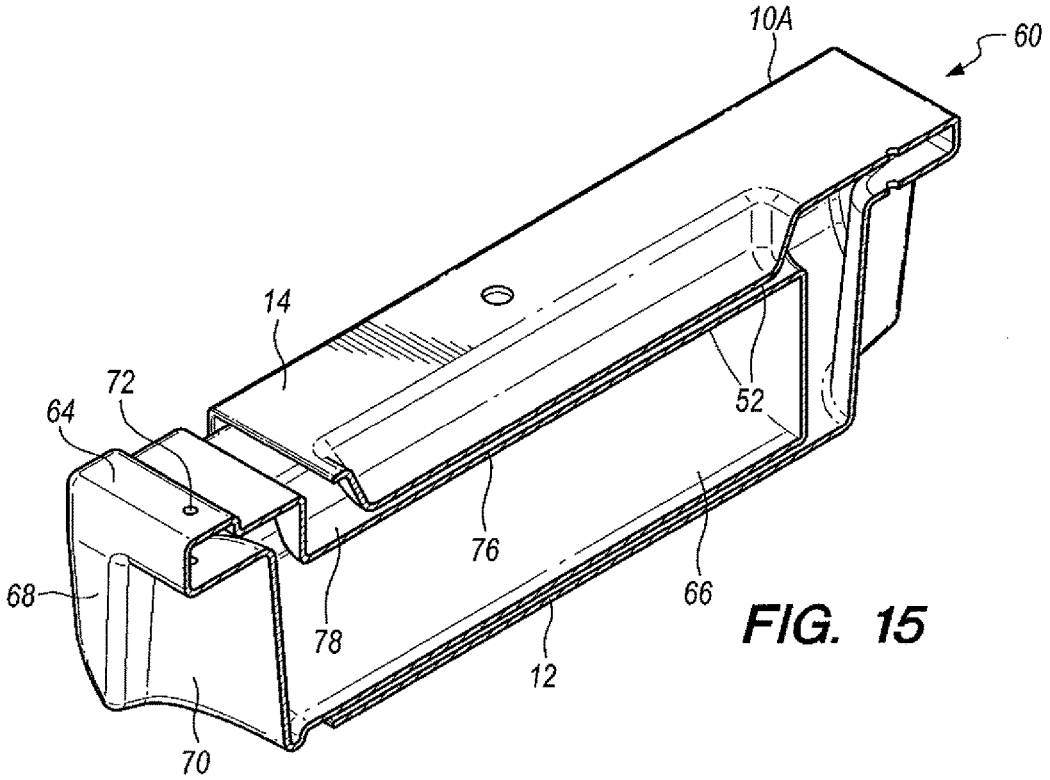
FIG. 15 is a cross sectional view of the second embodiment.

As perhaps may best be seen with reference to FIGS. 11, 12 and 13, the recesses 40 are partially defined by a recess bottom wall 42 at each end 18. The recess bottom wall has openings 44 located therein. The recess bottom wall 42 is spaced from shell bottom 14 and the openings 44 are in registry with bottom openings 46. The mounting hole 44 and the bottom opening 46 receive a bolt 48 used to secure the shell 10 to the upper portion of the roadway barrier segment.

At each bolt location, prior to insertion of the bolt, and is shown in FIGS. 11, 12 and 13, a sleeve 48, for example an aluminum sleeve, is located between the mounting holes and the bottom opening for additional strength and crush resistance when setting mounting hardware. This allows for the use of an impact wrench when setting the hardware for the apparatus without fear of causing damage to the polymer shell.

A raised channel 52 is formed at shell bottom 14, the raised channel 52 runs substantially the length of the shell bottom but terminates before reaching the opposed shell ends 18. This feature is an optional embedded structural feature that performs a desirable function when the first apparatus embodiment is converted into an outer shell employed in a second embodiment of the invention, which will now be described.

The second embodiment of the invention is designated by reference numeral 60 and is shown in FIGS. 2, 3, 6, 7, 8, 9, 14 and 15. Apparatus 60 includes an elongated hollow shell 10A which is essentially the same as shell 10 described above, except that the shell 10 has been converted to shell 10A by having one of the ends cut off, providing an end opening 62. Opening 62 communicates with the shell interior and is located in opposition to the remaining shell end 18.

This second embodiment of the invention includes a core member 64 having a core shell 66 and an end 68 attached to the core shell.

End 68 has a recessed area 70 which is considerably larger than the recesses 40 on shell 10. The recessed area for example may be almost twice as wide to accommodate two aluminum sleeved holes of slightly lower diameter. These holes, identified in the drawings as reference numeral 72, are the primary mounting point for the core member 64 comprised of core shell 66 and end 68. The remainder of the length of the second embodiment 60 is designed to fit inside the converted and open ended shell 10A, being of smaller overall dimension and containing a raised channel 76 which fits on top of the raised channel 52 of the first embodiment and defines a groove 78 receiving the raised channel 52. This acts as a linear guide and when assembled the structural elements of the second embodiment will slide through the hollow section of the modified outer shell of the first embodiment. Once collapsed, the second embodiment of the invention is almost identical in length and identical in height to the first embodiment of the invention described above. The matingly engaged channels formed in the core shell and in the elongated hollow shell limit relative linear movement therebetween.

As indicated above, the apparatus may be utilized with all types of roadway barriers, including guardrail systems. In the latter situation a flat beam, for example, could be used to provide an attachment support for the apparatus. The barrier could be a movable barrier, use of the apparatus on the barrier sections not interfering with barrier mobility.

The invention claimed is:

1. Roadway barrier bicycle safety apparatus for attachment to an upper portion of a roadway barrier segment and for topping said upper portion to prevent a bicycle and rider from extending or vaulting over said upper portion, said apparatus comprising:

an elongated shell having a shell top, a shell bottom, opposed shell side walls extending between said shell top and said shell bottom, and opposed shell ends extending upwardly from said shell bottom to said shell top, said shell top being smoothly curved over substantially the extent thereof and said shell configured so that it does not extend from the upper portion of the roadway barrier toward a passing bicycle or cyclist; and attachment structure for attaching the elongated shell in position on the roadway barrier segment upper portion.

2. The roadway barrier bicycle safety apparatus according to claim 1 wherein the opposed shell side walls and opposed shell ends are substantially aligned with sides and ends of the upper portion of the roadway barrier segment, said opposed shell side walls and said opposed shell ends extending upwardly, said shell top attached to said opposed shell side walls and said opposed shell ends and configured to define a shell top upper surface including a plurality of converging curved shell top upper surface portions.

3. The apparatus according to claim 2 wherein said shell top upper surface is convexly curved and said top upper surface portions converge toward an elevated location substantially midpoint along the shell top upper surface.

4. The apparatus according to claim 2 wherein said opposed shell ends define recesses and at least one opening in said shell bottom in communication with each of the recesses for accommodating said attachment structure for attaching the elongated shell to the upper portion of said roadway barrier segment.

5. The apparatus according to claim 4 wherein said opposed shell ends each include a recess bottom wall above said shell bottom and defining a space therewith, said recess bottom wall including at least one mounting hole communicating with said space and with said at least one opening in said bottom for accommodating a bolt or other mechanical fastener to secure the elongated shell to the upper portion of said roadway barrier segment.

6. The apparatus according to claim 5 additionally including a spacer between said recess bottom wall and said shell bottom for receiving said bolt or other mechanical fastener and operative to prevent overtightening of the bolt or other mechanical fastener and distribute load onto a larger area.

7. The apparatus according to claim 2 wherein a raised channel is formed at said shell bottom.

8. The apparatus according to claim 7 wherein said raised channel runs substantially the length of said shell bottom but terminates before reaching said opposed shell ends.

9. The apparatus according to claim 2 wherein said elongated shell is a polymer hollow shell.

10. Roadway barrier bicycle safety apparatus for attachment to an upper portion of a roadway barrier segment and for topping said upper portion to prevent a bicycle and rider from extending or vaulting over said upper portion, said apparatus comprising:

an elongated shell defining a shell interior and having a shell top, a shell bottom, opposed shell side walls extending between said shell top and said shell bottom, and a first shell end extending upwardly from said shell bottom to said shell top, said side walls and first shell end being substantially aligned with sides and an end of the upper portion of the roadway barrier segment when the elongated hollow shell is attached to the upper portion of the roadway barrier segment, said opposed shell side walls and first shell end extending upwardly, said shell top attached to said opposed shell side walls and said first shell end and configured to define a smoothly curved shell top upper surface.

11. The apparatus according to claim 10 wherein said elongated hollow shell has an opening communicating with the shell interior located in opposition to said first shell end and wherein said apparatus additionally comprises a core member inserted through said opening and into said shell interior, said core member comprising a core shell and a second end attached to said core shell.

12. The apparatus according to claim 11 wherein said second end is disposed externally of said shell interior.

13. The apparatus according to claim 12 wherein said core shell is mounted for linear adjustable movement relative to said elongated shell to vary the distance between said first end and said second end.

14. The apparatus according to claim 13 including structure for limiting relative linear movement between said core shell and said elongated shell.

15. The apparatus according to claim 14 wherein said structure for limiting relative linear movement comprises matingly engaged channels formed in said core shell and said elongated shell.

* * * * *